US006821241B2

(12) United States Patent
Herman et al.

(10) Patent No.: US 6,821,241 B2
(45) Date of Patent: Nov. 23, 2004

(54) CENTRIFUGE ROTOR WITH LOW-PRESSURE SHUT-OFF AND CAPACITY SENSOR

(75) Inventors: Peter K. Herman, Cookeville, TN (US); Kevin C. South, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 117 days.

(21) Appl. No.: 10/209,411

(22) Filed: Jul. 30, 2002

(65) Prior Publication Data

US 2004/0023782 A1 Feb. 5, 2004

(51) Int. Cl.[7] ..... B04B 9/06; B04B 11/04
(52) U.S. Cl. ..... 494/5; 494/49
(58) Field of Search ..... 494/5, 10, 38, 494/43, 49, 65, 68–70, 84, 901

(56) References Cited

U.S. PATENT DOCUMENTS 2,373,349 A * 4/1945 Serrell ..... 184/6.24
3,784,092 A * 1/1974 Gibson ..... 494/2
4,221,323 A * 9/1980 Courtot ..... 494/10
6,454,694 B1 * 9/2002 Herman et al. ..... 494/49

FOREIGN PATENT DOCUMENTS

EP 0 995 496 A3 4/2001
WO 92/16303 * 10/1992
WO WO 99/30827 6/1999

* cited by examiner

*Primary Examiner*—Charles E. Cooley
(74) *Attorney, Agent, or Firm*—Woodard, Emhardt, Moriarty, McNett & Henry LLP

(57) ABSTRACT

A centrifuge for separating particulate matter from a fluid includes a housing having a base portion defining a fluid inlet, a rotor subassembly in the housing and including a centertube and a shaft. The shaft defines a plurality of fluid outlet ports and a fluid passageway in flow communication therewith. The fluid passageway communicates with the fluid inlet such that oil delivered to the centrifuge flows through a portion of the centrifuge shaft and exits from the fluid outlet ports. Press fit into the centertube is a baffle sleeve which is initially positioned so as to cover the fluid outlet ports when the baffle sleeve is in a first position. The baffle sleeve is movable with the rotor subassembly to a second position where the plurality of fluid outlet ports are uncovered.

18 Claims, 5 Drawing Sheets

CENTRIFUGE ROTOR WITH LOW-PRESSURE SHUT-OFF AND CAPACITY SENSOR

BACKGROUND OF THE INVENTION

The present invention relates in general to the design of a centrifuge rotor which includes a flow shut-off baffle device that is assembled into a rotor subassembly. More specifically, the present invention relates to the design of a tubular baffle ring which press fits into a centertube and is positioned over a fluid inlet port defined in a rotor shaft for controlling the flow of fluid into the centrifuge rotor.

On many small engines, the lube pump is sized for maximum fuel economy, but the result can be dangerously low oil pressure during idle (or low speed) operation, especially if parasitic devices (accessories or a by-pass centrifuge) have been added. Accordingly, many engine manufacturers desire to limit oil flow to parasitic devices, such as a by-pass lube centrifuge, at low oil pressure conditions such as found during engine idle. The objective is to maintain maximum oil pressure to critical engine components such as a turbocharger, valve train, etc.

In the past, this function has been provided by adding a spring-loaded valve plunger to the inlet of the centrifuge. However, this adds significant cost and complexity to the centrifuge housing. This particular approach also adds some restriction to oil flow which causes reduced centrifuge rotor speed. The present invention provides a similar low-pressure cut-off function as part of a centrifuge without adding significant cost to the rotor or housing.

Additionally, there is a desire by customers (centrifuge users) to know or to be informed when a full-rotor condition exists, based on the amount or degree of sludge accumulation. In order to receive or extract the maximum value from the centrifuge rotor, it is important to avoid the premature service or replacement of the rotor. It has been found that the rotor speed does not significantly decrease when the rotor is (fully) loaded with sludge. As such, the speed decrease in the rate of rotor rotation is not large enough to yield a useful indication (of the speed decrease) to the operator. By means of the present invention, the speed of the rotor is caused to be reduced to near zero when the rotor is "full", thereby providing a simple and cost effective "capacity sensor" in conjunction with the described low-pressure cut off capability.

SUMMARY OF THE INVENTION

A centrifuge for separating particular matter from a fluid includes a housing having a base portion defining a fluid inlet, a rotor subassembly assembled into the housing, and including a centertube, a shaft extending through a portion of the centertube, and defining a fluid inlet port and a fluid passageway in flow communication with the fluid inlet. The improvement corresponding to the present invention includes a baffle sleeve assembled into the centertube and positioned so as to cover the fluid inlet port in the shaft while in a first position, the baffle sleeve and the rotor subassembly being movable to a second position where the fluid inlet port of the shaft is uncovered by the baffle sleeve.

One object of the present invention is to provide an improved rotor subassembly for a centrifuge.

Related objects and advantages of the present invention will be apparent from the following description.

DESCRIPTION OF THE PREFERRED EMBODIMENTS

Figure 1:
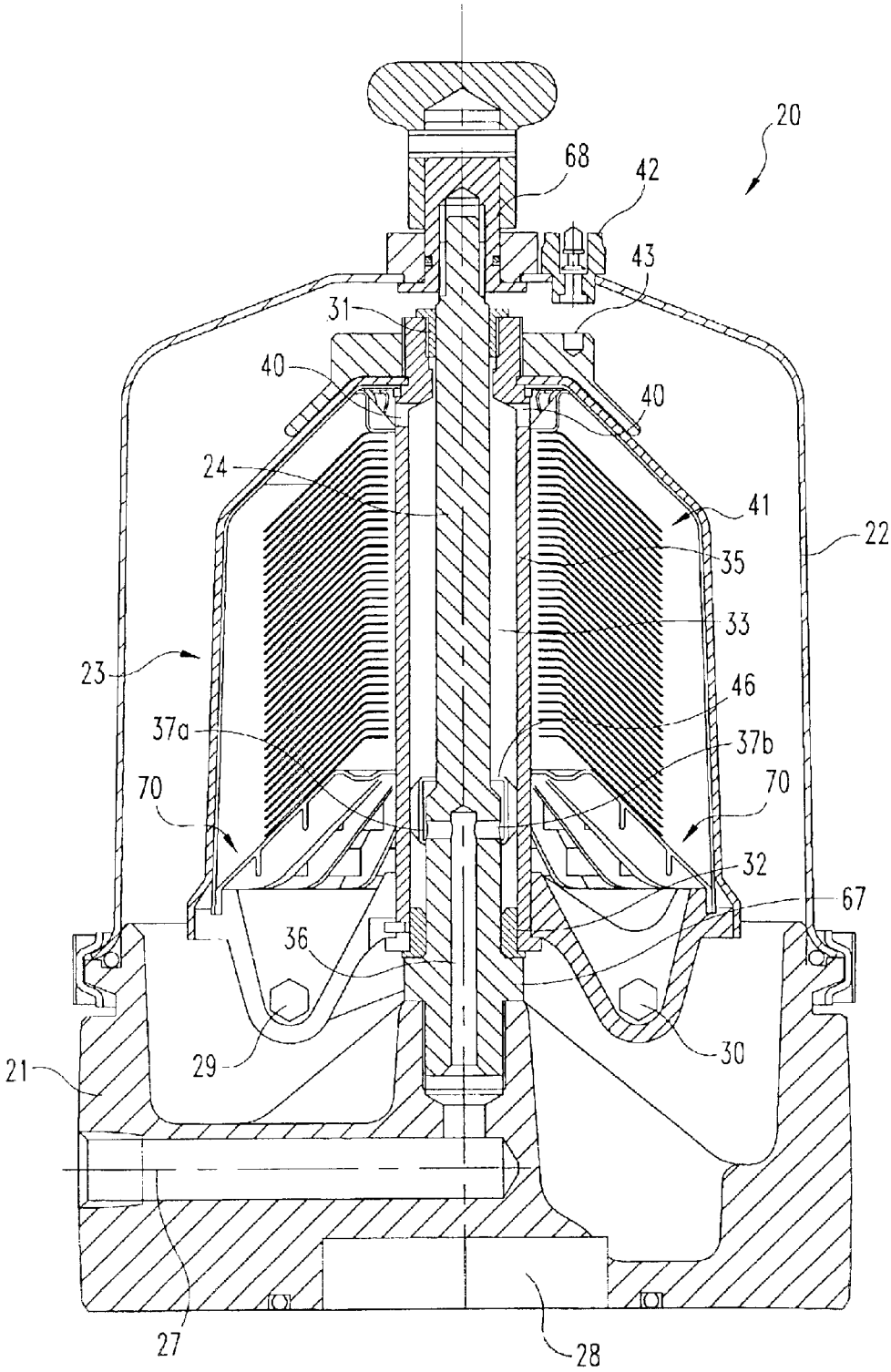
FIG. 1 is a front elevational view in full section of a centrifuge according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a pressure-driven, by-pass centrifuge 20 which includes a base 21, outer housing 22, rotor subassembly 23, and shaft 24. The base defines a fluid inlet 27 and a drain 28. In the preferred embodiment, the fluid being processed by the centrifuge 20 is oil from a vehicle/engine (not illustrated). The rotor subassembly 23 is a self-driven design using the out flow of oil from jet nozzles 29 and 30 to effect rotary motion of the rotor subassembly 23 relative to base 21 and outer housing 22. In this regard, the rotor subassembly 23 is bearingly mounted to shaft 24 at locations 31 and 32. The rotor subassembly 23 includes a centertube 35 which is generally concentric with shaft 24 and spaced apart from the shaft so as to define an annular clearance space 33 therebetween. Although included as part of FIG. 1, baffle sleeve 46, whose design and function is described later, is not included in the description of centrifuge operation which follows. It is helpful to understand centrifuge operation without the baffle sleeve 46 so that the benefits of the baffle sleeve 46 will be clear.

Now considering the operation of centrifuge 20, the annular clearance space 33 permits the flow of fluid (oil) upwardly between the shaft 24 and centertube 35 which is then processed by the rotor subassembly. The processed fluid is used as the fluid to drive the rotor subassembly rotation via jet nozzles 29 and 30. The shaft defines a central fluid passageway 36 which is in fluid flow communication with fluid inlet 27 via base 21. Shaft 24 defines at least one intersecting bore which extends through the side wall of shaft 24 so as to intersect into passageway 36. In the illustrated embodiment, a single intersecting through bore creates two (180 degrees apart) shaft fluid outlet ports 37*a*, 37*b*. These two fluid outlet ports are in flow communication with fluid passageway 36.

In operation, the operating fluid, preferably oil, enters the centrifuge 20 by fluid inlet 27 in base 21. The flow of oil travels up through passageway 36 and out through the two shaft outlet ports (37*a*, 37*b*) into annular clearance space 33. The oil continues to flow upwardly through the clearance space 33 and then exits at centertube flow outlets 40 and begins its processing path through the rotor fluid processing mechanism 41 which, in the illustrated and preferred embodiment of FIG. 1, is a cone-stack subassembly. As the oil is processed by the cone-stack subassembly 41, particulate matter is separated from the oil by centrifugal action resulting from the rotational speed of the rotor subassembly 23. The processed (i.e., cleaned) oil that exits from the cone-stack subassembly 41 exits from the jet nozzles 29 and 30 and this Hero turbine action creates the self-driving rotation of the rotor subassembly 23. The oil exiting from the two jet nozzles 29 and 30 flows back to sump via the oil drain 28 in base 21.

While the rotor subassembly 23 is supported on shaft 24 at upper and lower bearing locations 31 and 32, respectively, the rotor subassembly 23 is able to move axially in an upward direction on shaft 24, noting that this upward axial movement or floatation occurs at a full operating pressure. This axial movement/floatation helps the rotor subassembly 23 spin at a higher speed which is important in the centrifuge design and facilitated since the weight of the rotor subassembly 23 does not rest on the spacer section 67 of shaft 24. With the interior of the rotor subassembly pressurized, the fluid pressure acts over a larger projected area at the upper bearing location as compared to the projected area at the lower bearing location, resulting in a lifting force. This lifting force is a function of the fluid pressure acting on the projected area difference between the upper and lower bearing areas. This particular aspect of the present invention will be described in greater detail hereinafter.

Briefly recapping one of the points discussed in the Background section, many engine manufacturers desire to limit flow to parasitic devices at low oil pressure conditions, such as during idle or low speed operation, in order to maintain maximum oil pressure to critical engine components such as turbochargers and valve trains. Parasitic devices include less critical engine accessories such as a by-pass centrifuge, such as by-pass centrifuge 20. One technique which may be utilized to control the flow of oil to a by-pass centrifuge is to install a low pressure cut off valve such that the flow of oil is shut off below a preset point, based on the fluid pressure level. One technique employed for achieving this function is to add a spring-loaded valve plunger to the fluid inlet. One disadvantage of this approach is the added cost and complexity to the centrifuge design. Further, with pressure cut off valve designs of this type, there will likely be a restriction to the centrifuge inlet and this affects the maximum rotor speed and this is seen as a speed penalty in terms of centrifuge performance.

Another product design feature which is of interest to a number of customers is to be able to know when a "full-rotor" condition exists. In order to maximize the value of the rotor by avoiding premature service or replacement, it is necessary to know when the rotor is "full" of collected sludge. The task is how to know when to service or replace the rotor since the rotor subassembly is encased within the outer housing 22 and base 21. While it is known that the rotor speed shows a slight decrease when it is fully loaded with sludge, the magnitude of the speed decrease is not enough to yield a useful indication to the operator. While rotor speed sensing devices are used, there is still not the ability to determine when the rotor is full, based solely on the slight speed decrease. The FIG. 1 by-pass centrifuge 20 includes a speed indicator in the form of an LED/indicator assembly 42 which cooperates with a magnet 43 positioned on the rotor subassembly 23.

Noting the areas for improvement in the design of a by-pass centrifuge, the present invention, as described herein, is directed to providing a novel and unobvious low-pressure shut-off structure which is also capable of helping to provide a reliable indication of a full rotor condition. The focus of the present invention is the design of a generally cylindrical baffle sleeve 46 which press fits into centertube 35 and is positioned around shaft 24 so as to be placed in the annular clearance space 33. While a press-fit assembly is preferred, the baffle sleeve 46 can also be secured in position inside of the centertube and around the shaft by the use of adhesive, welding, threading or even molding or machining. A further option would be a snap-fit construction. The baffle sleeve 46 is designed in its normally-closed condition to fit over and cover the two shaft inlet ports defined by shaft 24 and represented by reference numerals 37*a*, 37*b*. Due to the press fit, the baffle sleeve is designed to move with the rotor subassembly 23 in an axially upward direction to an "open" condition in response to an incoming fluid pressure if it is at a pressure level which is sufficient to "lift" the weight of the rotor subassembly, including the baffle sleeve 46. The baffle sleeve 46 is illustrated in FIG. 1 and the design details of the baffle sleeve and its operation and cooperation with rotor subassembly 23 will now be described in the context of drawing FIGS. 2–8. In terms of the "open" condition referred to above, this is defined to be that position of the baffle sleeve 46 whereat it does not cover the two shaft inlet ports (37*a*, 37*b*).

Figure 2:
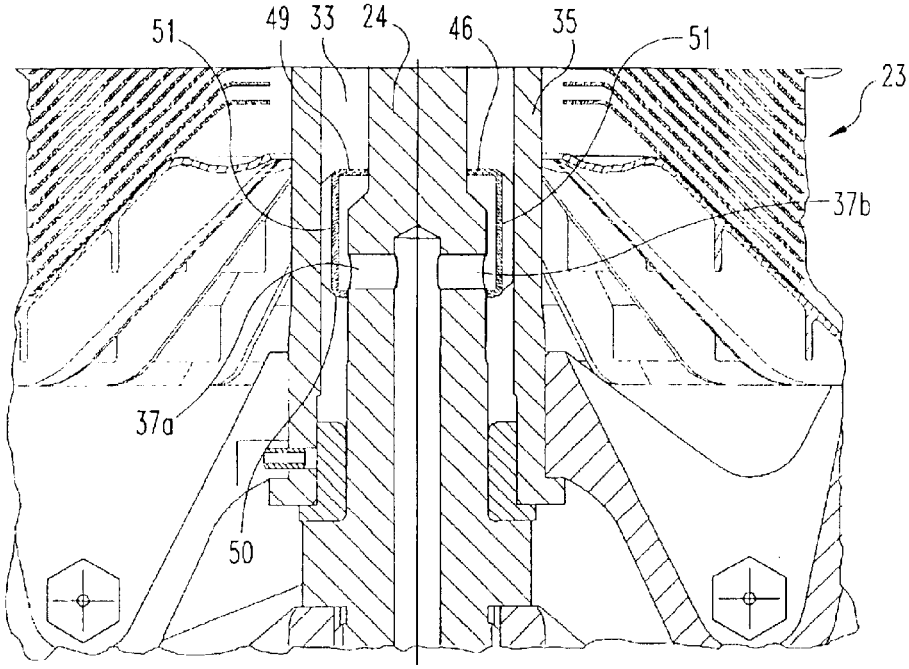
FIG. 2 is a partial, enlarged, front elevational view, in full section, of a baffle sleeve arranged as part of a rotor subassembly of the FIG. 1 centrifuge, illustrated in a first position.
Figure 3:
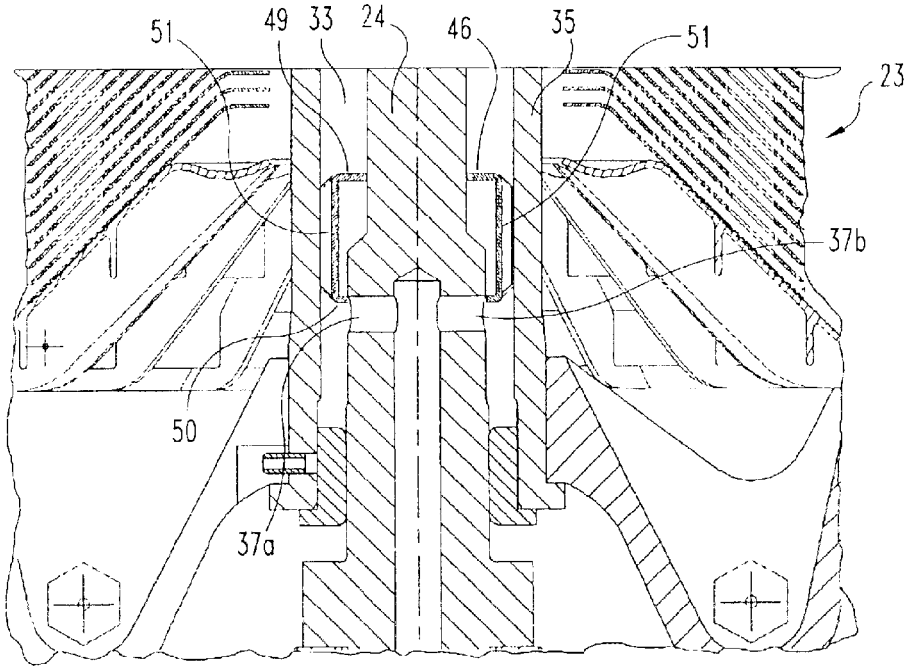
FIG. 3 is a partial, enlarged, front elevational view, in full section, of the FIG. 2 baffle sleeve and rotor subassembly, illustrated in a second position.
Figure 4:
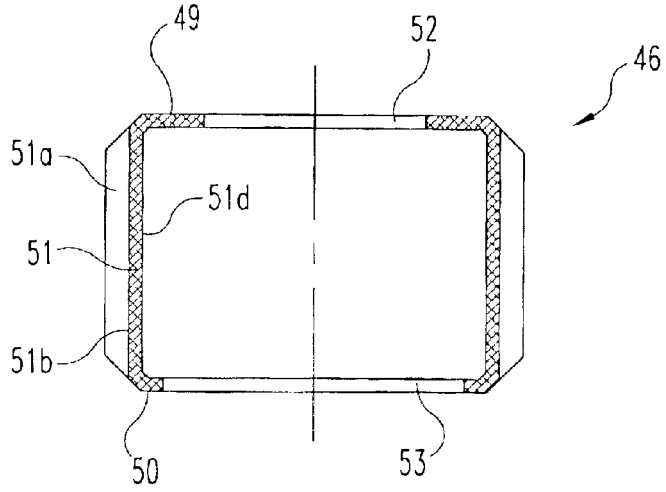
FIG. 4 is an enlarged, front elevational view in full section of the FIG. 2 baffle sleeve.
Figure 5:
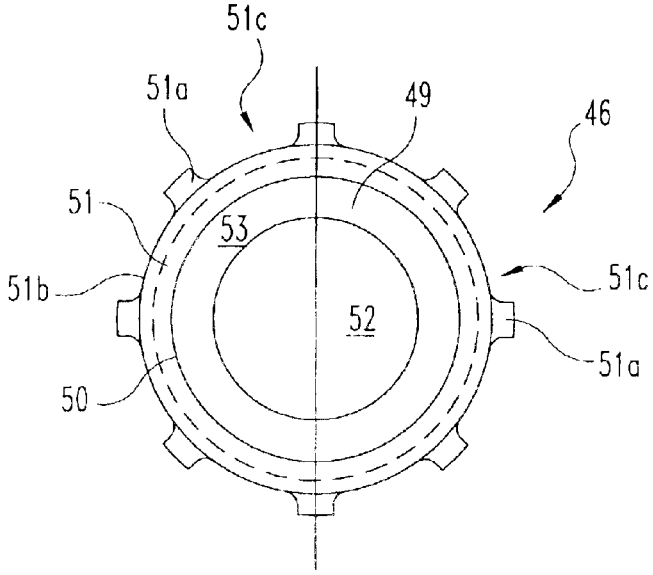
FIG. 5 is a bottom plan view of the FIG. 4 baffle sleeve, shown in full form.

With reference to FIGS. 2–8, the details of baffle sleeve 46 and its assembly into centertube 35 (press fit) and onto shaft 24 as part of rotor subassembly 23 are illustrated. The baffle sleeve 46 is best described as a generally tubular or cylindrical structure and, as illustrated, includes an upper radial wall 49, a lower radial wall 50, and a cylindrical sidewall 51 extending axially between wall 49 and wall 50. With reference to FIGS. 4 and 5, extending axially for approximately the full height (length) of sidewall 51, are a series of eight flow-defining ribs 51*a* which are uniformly spaced around the circumferential outer surface 51*b* of sidewall 51. The outwardly extending (raised form) of each rib 51*a* is such that the diameter dimension across each diametrically opposed pair of ribs 51*a* creates a press fit against the inside surface of centertube 35. The clearance spaces 51*c* disposed between each adjacent pair of ribs 51*a* assume the configuration of axially-extending fluid flow channels once enclosed by the inside surface of centertube 35. As will be described, the press fit of the baffle sleeve 46 into centertube 35 causes the baffle sleeve 46 and rotor subassembly 23 to move (axially) as a single unit. Accordingly, once the baffle sleeve lifts or moves in an axially upward direction, the rotor subassembly moves with the baffle sleeve, and vice versa. As the baffle sleeve 46 lifts in this manner, the two shaft inlet ports (represented by 37*a*, 37*b*) are exposed such that oil flowing out of these shaft outlet ports is able to flow upwardly through annular clearance space 33, past the baffle sleeve 46 by flowing through the eight clearance spaces 51*c*.

The baffle sleeve 46 is a unitary member wherein the upper radial wall 49 defines a generally circular clearance hole 52 and the lower radial wall 50 defines a generally circular clearance hole 53. Clearance hole 52 has a diameter size of approximately 0.59±0.001 inches and clearance hole 53 has a diameter size of approximately 0.831±0.001 inches. Configuring clearance holes 52 and 53 with different diameter sizes corresponds with the design of shaft 24 which is configured with two primary sections 54 and 55 with a bevel (chamfer) interface 56 therebetween. The approximate diameter of section 54 is 0.59±0.0005 inches and the approximately diameter size of section 55 is 0.827±0.0005 inches. As would be understood from a review of these dimensions and as illustrated in FIGS. 2 and 3, the baffle sleeve 46 fits closely onto shaft 24 such that shaft section 54 fits in clearance hole 52 and such that shaft section 55 fits in clearance hole 53. Since the baffle sleeve 46 is press fit into centertube 35, these two members move together as a single unit. In the cross sectional view of FIGS. 2 and 3, the upper radial wall 49 appears as two radial lips contacting the outer surface of shaft section 54 and the lower radial wall 50 appears as two radial lips contacting the outer surface of shaft section 55. There is a very close fit of the walls 49 and 50 to their corresponding shaft sections 54 and 55, sufficient to create an interface with minimal leakage at both locations, given the expected viscosity of the oil over a normal operating range of temperatures. While there is a minimum leakage interface at both locations, the baffle sleeve 46 is still able to axially move in the upward direction with the rotor subassembly 23 relative to shaft 24.

As illustrated in FIG. 2, the position of the baffle sleeve 46 on shaft 24 places the cylindrical sidewall 51 in a blocking position over the two shaft outlet ports 37*a*, 37*b*. While the baffle sleeve 46 is able to "float" up or lift along with the remainder of the rotor subassembly 23 in response to oil pressure to an "open" condition (see FIG. 3), the force exerted by the oil pressure exiting out of the shaft outlet ports 37*a*, 37*b* needs to be at a level which is sufficient to overcome the weight of the rotor subassembly 23. A "low" oil pressure, which is defined as the predetermined pressure at or below which oil is not to be delivered to the centrifuge, is designed with consideration of the overall weight of the rotor subassembly 23. The differential areas of the upper and lower radial walls 49 and 50 which are exposed to the oil exiting from the shaft outlet ports 37*a*, 37*b* are initially important, but ultimately it is the difference in projected areas between the upper bearing and the lower bearing which help to define the resultant lifting force.

In describing the present invention, it is important to recognize that we could have an empty rotor assembly just ready to be filled with oil or a full rotor assembly wherein the engine is transitioning to an idle or low speed condition. If we begin with an empty rotor subassembly 23 and initiate a flow of oil (under pressure) into the centrifuge 20, the constructed flow path delivers the oil to outlet ports 37*a*, 37*b* in shaft 24 and thus into the baffle sleeve 46. The differential top and bottom projected areas of the baffle sleeve results in a net fluid pressure force acting upwardly on the upper wall of the baffle sleeve. When the oil pressure is high enough to generate a force that exceeds the weight of the rotor subassembly 23, the rotor subassembly 23 lifts or "floats" upwardly relative to shaft 24. This lifted condition is illustrated in FIG. 3. As soon as the baffle sleeve 46 rises to a point that the shaft outlet ports 37*a*, 37*b* are exposed (i.e., unblocked), the incoming oil flows into the clearance space 33 and into the rotor subassembly 23, downwardly as well as upwardly by way of the channels formed by clearance spaces 51*c* in the baffle sleeve 46.

As the rotor subassembly 23 fills with oil, its weight increases and if the fluid (oil) pressure at that time is not yet high enough to create a force sufficient to exceed this increased rotor subassembly weight, the lifted rotor subassembly "sink" or lowers. As the baffle sleeve sinks to a lower position with the rotor subassembly 23, the outlet ports 37*a*, 37*b* in the shaft again become covered by the baffle sleeve 46 and the captured incoming oil flow causes the fluid pressure to build inside the baffle sleeve and once again the baffle sleeve and the rotor subassembly 23 lift as a unit.

As more oil flows into the rotor subassembly 23, the overall weight once again increases and now to an even higher level and the cyclic process of floating and sinking of the rotor subassembly continues in something of an oscillating manner until the rotor subassembly is filled with oil. Ultimately the filled rotor assembly remains in a lifted position because the pressure level, as throttled by the jet nozzles 29 and 30, is high enough relative to the difference in the projected area adjacent the upper bearing versus the projected area adjacent the lower bearing to lift the oil-filled rotor subassembly.

Now consider the situation of a filled, steady-state rotor subassembly 23 and a reduction in oil pressure due to a speed reduction, such as going to an idle condition. As the oil pressure is reduced, the lifting force is also reduced and as this occurs, the rotor subassembly, which is still substantially filled with oil, sinks and shortly the baffle sleeve 46 covers over the shaft outlet ports 37*a*, 37*b*. When these shaft outlet ports are covered once again by the baffle sleeve 46, the flow of oil to the centrifuge is stopped. Since the oil pressure at this point is not sufficient to lift the rotor subassembly weight, the baffle sleeve is not lifted and the outlet ports in the shaft remain covered by the baffle sleeve, thereby blocking the flow of oil.

The foregoing operational explanation is expanded upon by the following description. With continued reference to FIG. 4, it will be seen that since sidewall 51 has a straight cylindrical inner surface 51*d* of a uniform inside diameter dimension, the inside surface area of upper radial wall 49 which is exposed to a fluid pressure due to the flow out of ports 37*a*, 37*b*, is calculated by the equation:

$$A_1 = \left(\frac{D}{2}\right)^2 \pi - \left(\frac{d_1}{2}\right)^2 \pi \qquad \text{EQUATION 1}$$

where, $d_1$=the diameter of clearance hole 52, $A_1$=the area of the upper radial wall, D=the inside diameter of sidewall 51.

The area ($A_2$) of the lower radial wall 50, which is exposed to a fluid pressure, is calculated by the equation:

$$A_2 = \left(\frac{D}{2}\right)^2 \pi - \left(\frac{d_2}{2}\right)^2 \pi \qquad \text{EQUATION 2}$$

where, $d_2$=the diameter of clearance hole 53.

Since the fluid pressure from ports 37*a*, 37*b*, which is generated on the interior of baffle sleeve 46 and actually trapped there, is uniformly applied to areas $A_1$ and $A_2$, the area size difference, noting that $A_1$ is larger is than $A_2$, equates to the lifting force on baffle sleeve 46, enabling the baffle sleeve and the remainder of the rotor subassembly 23 to move axially in an upward direction to the FIG. 3 orientation when the pressure is above the predetermined threshold level. Due to the press fit of the baffle sleeve 46 into centertube 35, the baffle sleeve and centertube act as an integral unit. The initial lifting force (LF) on baffle sleeve 46 and in turn on the empty rotor assembly 23 is given by the equation:

$$LF = P\pi\left[\frac{d_2^2 - d_1^2}{4}\right] \quad \text{EQUATION 3}$$

where P is the pressure of the incoming oil. When the lifting force (LF) exceeds the weight of the rotor subassembly 23, the rotor subassembly lifts upward (FIG. 3) and the empty rotor subassembly 23 begins to fill with oil, assuming that any minor leakage past the "seal" interface between clearance holes 52 and 53 and shaft sections 54 and 55, respectively, has not already filled the rotor subassembly 23. Ultimately the jet nozzles 29 and 30 become the throttling locations and the fluid pressure at the shaft ports 37*a*, 37*b* is the fluid pressure which is seen inside the rotor subassembly 23.

From the lifting force equation, it will be clear that by varying the differential areas of walls 49 and 50, the lifting force acting on the baffle sleeve can be varied, given a particular threshold pressure (P). The point at which the baffle sleeve 46 and rotor subassembly 23 begin to lift in an upward axial direction can also be adjusted for a given pressure and differential area by changing the weight of the rotor subassembly 23. Regardless of the initial weight of the rotor subassembly, there is a changing weight to the rotor subassembly which occurs as the empty rotor subassembly begins to fill with oil. In a filled condition, the rotor remains lifted as long as the force from the pressure applied to the projected area differences exceeds the weight. This projected area is derived by looking at the area adjacent the upper bearing location which the fluid pressure acts upon as compared to the smaller projected area adjacent the lower bearing where the fluid also acts. This surface area difference between the corresponding projected areas that the fluid acts upon adjacent the upper bearing, as compared to that adjacent the lower bearing, is in a similar ratio to the projected area differences within the baffle sleeve. As such, at full operating pressure, the requisite lifting force remains and the rotor subassembly remains in a lifted condition, although filled with oil, and the interior pressure is maintained due to the throttling action provided by jet nozzles 29 and 30.

As the rotor subassembly processes the oil flowing therethrough, there is an accumulation of sludge and as this sludge is collected within the rotor subassembly, it adds to the overall weight of the rotor subassembly due to the fact that the sludge has a greater weight density than a corresponding volume of oil. In time, with the continued accumulation of sludge, the increase in weight becomes such that the available fluid pressure, relative to the differential areas, is not sufficient to continue lifting the rotor subassembly. When the weight becomes too much, the rotor subassembly 23 sinks or floats back down to a position where the baffle sleeve 46 covers over the shaft ports 37*a*, 37*b*. This particular sequence is discussed in greater detail hereinafter.

As a design alternative to the baffle sleeve 46 design of FIGS. 4 and 5, it is envisioned that the outside diameter surface 51*b* can be free of any ribs 51*a* and instead provide the ribs as part of the inside surface of centertube 45. There needs to be at least one flow channel for oil to move past baffle sleeve 46 once shaft ports 37*a*, 37*b* are exposed and reach the remainder (downstream) of the rotor assembly 23. Since the ribs help define the necessary flow channels between the baffle sleeve and the centertube, the defining ribs can be a unitary part of the baffle sleeve as already described in the context of FIGS. 4 and 5 or can be a unitary part of the inside surface of the centertube 35 as conceived of for the alternate design embodiment according to the present invention. In either embodiment, there is still a press fit of the baffle sleeve into the centertube.

Figure 6:
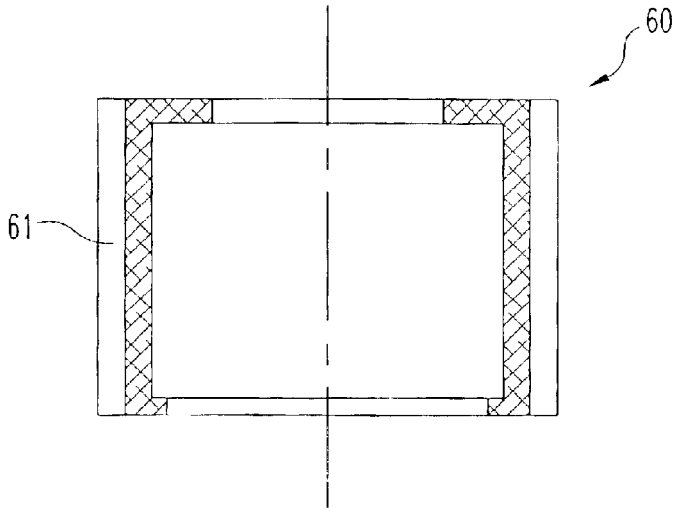
FIG. 6 is an enlarged, front elevational view in full section of an alternate embodiment of the baffle sleeve of the present invention.
Figure 7:
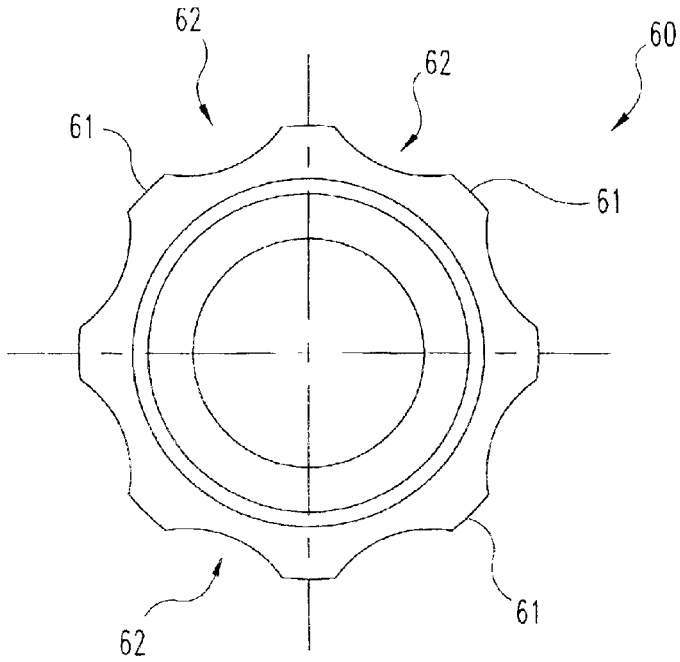
FIG. 7 is a bottom plan view of the FIG. 6 baffle sleeve, illustrated in full form.

With reference to FIGS. 6 and 7, an alternate design configuration for a suitable baffle sleeve and its ribs, according to the present invention, is illustrated. While baffle sleeve 60 is virtually identical to baffle sleeve 46, the principal difference is found in the shape (lateral cross section) of the ribs 61 as compared to ribs 51*a*. Ribs 61 are created by first selecting the outside diameter size which is desired for the requisite press fit against the inside diameter of the centertube 35. The next fabrication step is to use a ½ inch diameter end mill to create the flow channels 62. This results in more of a serrated design for the spaced series of ribs 61 as compared to ribs 51 which are narrow and thus the flow channels are wider.

Figure 8:
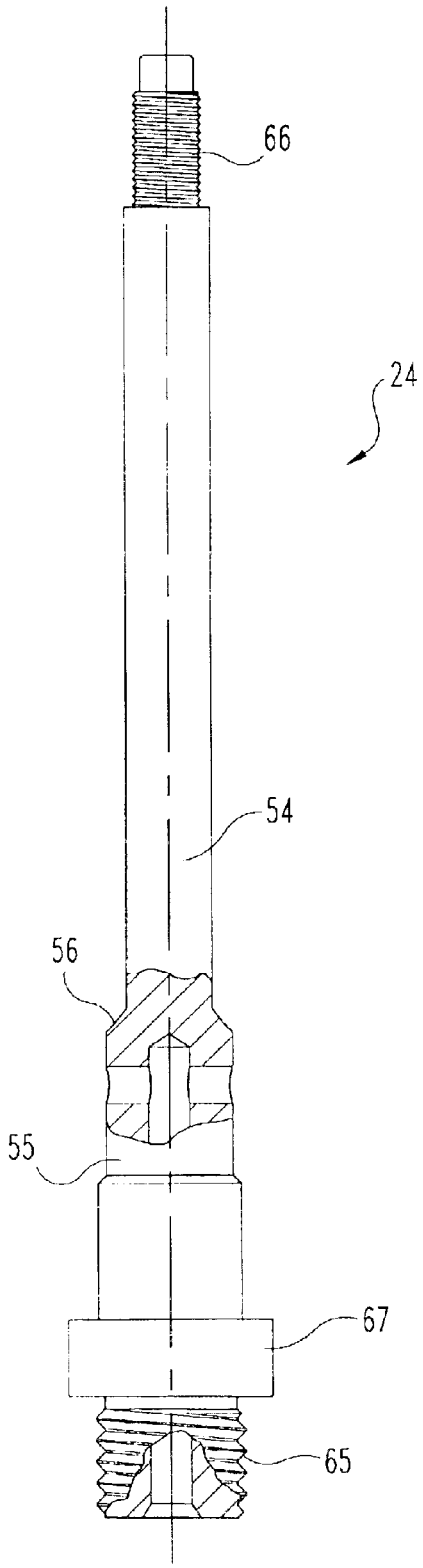
FIG. 8 is a fragmentary, front elevational view of the shaft of the FIG. 1 centrifuge.

With reference to FIG. 8, the shaft 24 which is designed for the present invention is illustrated. Included are shaft sections 54 and 55 and the chamfered interface 56. Additional sections of shaft 24 include externally-threaded section 65, externally-threaded section 66, and spacer section 67. Section 65 is threadedly received by the base 21 (see FIG. 1) and section 66 is threadedly received by upper fitting 68. Section 67 provides a shoulder for the lower bearing 32 as is illustrated in FIG. 1. Representative dimensions for shaft 24, including externally-threaded sections 65 and 66, include the overall length of 9.93 inches, the section 54 length of 5.551 inches, the section 55 length of 1.866 inches, the section 67 length of 0.508 inches, the threaded section 65 length of 0.750 inches, and the threaded section 66 length of 0.736 inches.

It was mentioned earlier in the context of the present invention that there is a benefit to the operator, from a cost perspective, to be able to tell when the rotor subassembly 23 is at its capacity for sludge collection, i.e., a "full-rotor" condition. Having this knowledge permits the operator to be able to service the rotor subassembly, either by cleaning the rotor subassembly or by replacement when the rotor subassembly is designed as a disposable/replaceable unit. By being able to either clean or replace the rotor subassembly at the correct time in the sense of not doing so with premature service or replacement enables greater utilization of the rotor subassembly and a more cost effective and efficient operation. As the interior of the rotor subassembly collects sludge, it begins with deposits in the outer collection zones, generally located at location 70 in FIG. 1. As the rotor assembly approaches a "full-rotor" condition, the collected sludge reaches a level whereat its added weight in the filled rotor subassembly can exceed the design lifting force derived from the fluid pressure applied to the projected differential areas. If the required fluid pressure for "lifting" the added weight is not present, even at a full operating pressure, then the rotor subassembly does not lift and the rotor subassembly sinks and the baffle sleeve is lowered to its blocking position over the fluid outlet ports 37*a*, 37*b* in the shaft. Since the available pressure as applied to the differential area of the baffle sleeve is also not sufficient to lift the added weight, the fluid flow into the rotor subassembly stops and the rotor subassembly is not able to spin. This shows up as a "zero speed" fault or at least a very low speed indication. This can be determined from indicator assembly 42, signaling the operator that service or replacement of the rotor subassembly is required. The required weight for the filled rotor subassembly to effect this result can be adjusted based on the fluid pressure levels to be expected by adjusting the starting weight of the rotor subassembly and the differential projected areas of the upper bearing area and the lower bearing area.

Another feature of the present invention relates to the distance of separation between clearance holes 52 and 53 and shaft sections 54 and 55, respectively. It is desired that the radial gap be as large as possible to avoid tight manufacturing tolerances. The allowable clearance gap depends largely on the jet nozzle area and the rated flow rate, since leakage past the edges of the clearance holes 52 and 53 flows to the jet nozzles 29 and 30. If these jet nozzles provide a substantial "back pressure" at the leakage flow rate, the rotor subassembly 23 will not float in an upward axial direction nor will the rotor subassembly spin properly.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifuge for separating particulate matter from a fluid wherein the centrifuge includes a housing having a base portion defining a fluid inlet, a rotor subassembly assembled into said housing and including a centertube, a shaft extending through a portion of said centertube, said shaft defining a fluid outlet port and a fluid passageway that is in flow communication with the fluid outlet port and with the fluid inlet, wherein the improvement comprises:

a baffle sleeve assembled into the centertube and positioned so as to cover said fluid outlet port when in a first position and being movable with the rotor subassembly to a second position wherein said fluid outlet port is uncovered by said baffle sleeve.

2. The centrifuge of claim 1 wherein said baffle sleeve is constructed and arranged as a tubular member having a first radial wall, a second radial wall, and a generally cylindrical sidewall therebetween.

3. The centrifuge of claim 2 wherein said first radial wall defines a first clearance hole of a first diameter size.

4. The centrifuge of claim 3 wherein said second radial wall defines a second clearance hole of a second diameter size.

5. The centrifuge of claim 4 wherein said first diameter size is smaller than said second diameter size.

6. The centrifuge of claim 1 wherein said baffle sleeve is press fit into said centertube.

7. The centrifuge of claim 6 wherein said baffle sleeve includes a plurality of exterior ribs defining at least one flow channel.

8. The centrifuge of claim 1 wherein said baffle sleeve includes a plurality of exterior ribs defining at least one flow channel.

9. In combination:

a centrifuge shaft defining a fluid passageway and in flow communication therewith, a fluid outlet port, said centrifuge shaft being fixed to a centrifuge base; and a movable flow-control sleeve assembled onto said centrifuge shaft, said flow-control sleeve being constructed and arranged to close off said fluid outlet port by covering said fluid outlet port in a first position thereby preventing fluid flow out of said fluid outlet port, said flow-control sleeve being movable to a second position where said fluid outlet port is uncovered by said flow-control sleeve.

10. The combination of claim 9 wherein said flow-control sleeve includes a plurality of exterior ribs defining at least one flow channel.

11. In combination:

a centrifuge shaft defining a fluid passageway and in flow communication therewith, a fluid outlet port; and a movable flow-control sleeve assembled onto said centrifuge shaft and positioned to cover said fluid outlet port in a first position and being movable to a second position where said fluid outlet port is uncovered by said flow-control sleeve, wherein said flow-control sleeve is constructed and arranged as a tubular member having a first radial wall, a second radial wall, and a generally cylindrical sidewall therebetween.

12. The combination of claim 11 wherein said first radial wall defines a first clearance hole of a first diameter size.

13. The combination of claim 12 wherein said second radial wall defines a second clearance hole of a second diameter size.

14. The combination of claim 13 wherein said first diameter size is smaller than said second diameter size.

15. In combination:

a centrifuge shaft defining a fluid passageway and in flow communication therewith, a fluid outlet port; and a movable flow-control sleeve assembled onto said centrifuge shaft and positioned to cover said fluid outlet port in a first position and being movable to a second position where said fluid outlet port is uncovered by said flow-control sleeve, wherein said centrifuge shaft includes a first section having a first diameter size and a second section having a second diameter size which is larger than said first diameter size and said flow-control sleeve defining a first clearance hole positioned around said first section and a second clearance hole positioned around said second section.

16. The combination of claim 15 wherein said sleeve is constructed and arranged as a tubular member having a first radial wall, a second radial wall, and a generally cylindrical sidewall therebetween.

17. In combination:

a centrifuge shaft defining a fluid passageway and in flow communication therewith, a fluid outlet port; and a movable flow-control sleeve assembled onto said centrifuge shaft and positioned to cover said fluid outlet port in a first position and being movable to a second position where said fluid outlet port is uncovered by said flow-control sleeve, wherein said flow control sleeve is constructed and arranged with a first radial wall, a second radial wall, and a sidewall therebetween, said first and second radial walls in cooperation with said sidewall defining an interior space, said fluid outlet port being in flow communication with said interior space.

18. In combination:

a centrifuge shaft defining a fluid passageway and in flow communication therewith, a fluid outlet port, said centrifuge shaft being fixed to a centrifuge base; and a flow-control sleeve assembled onto said centrifuge shaft, said flow-control sleeve being constructed and arranged relative to said centrifuge shaft to be movable to a flow position relative to said centrifuge shaft based on a fluid pressure from said fluid outlet port that exceeds a pressure threshold, said flow-control sleeve being constructed and arranged relative to said centrifuge shaft to be movable due to gravity to a closing position relative to said centrifuge shaft when the fluid pressure from said fluid outlet port is below said pressure threshold.

* * * * *

UNITED STATES PATENT AND TRADEMARK OFFICE

CERTIFICATE OF CORRECTION

PATENT NO. : 6,821,241 B2
DATED : November 23, 2004
INVENTOR(S) : Herman et al.

It is certified that error appears in the above-identified patent and that said Letters Patent is hereby corrected as shown below:

Column 9,
Line 55, insert -- shaft -- between “centrifuge” and “base”.

Signed and Sealed this

Twenty-seventh Day of September, 2005

JON W. DUDAS
*Director of the United States Patent and Trademark Office*